US005515926A

United States Patent [19]

Boychuk

[11] Patent Number: 5,515,926

[45] Date of Patent: May 14, 1996

[54] APPARATUS AND METHOD FOR INSTALLING COILED TUBING IN A WELL

[76] Inventor: Randy J. Boychuk, 7815 Leaf Point Ct., Houston, Tex. 77551

[21] Appl. No.: 370,649

[22] Filed: Jan. 10, 1995

Related U.S. Application Data

[63] Continuation-in-part of Ser. No. 308,407, Sep. 18, 1994.

[51] Int. Cl.[6] ..... E21B 19/10; E21B 33/04

[52] U.S. Cl. ..... 166/379; 166/88.3; 166/382; 285/145; 285/147

[58] Field of Search ..... 166/88, 86, 77, 166/379, 382; 285/147, 146, 145

[56] References Cited

U.S. PATENT DOCUMENTS

| | | | |
|---|---|---|---|
| 1,579,648 | 4/1926 | Crickmer | 285/147 |
| 2,137,853 | 11/1938 | Nixon | 285/146 X |
| 2,194,265 | 3/1940 | Abercrombie | 285/147 X |
| 3,090,640 | 5/1963 | Otteman et al. | 285/145 X |
| 4,646,827 | 3/1987 | Cobb | 166/88 |
| 4,844,166 | 7/1989 | Going, III et al. | 166/379 |
| 5,027,903 | 7/1991 | Gipson | 166/382 |
| 5,092,400 | 3/1992 | Jagert | 166/88 |
| 5,411,085 | 5/1995 | Moore et al. | 166/242 |

*Primary Examiner*—Hoang C. Dang
*Attorney, Agent, or Firm*—Bill B. Berryhill

[57] ABSTRACT

Hanger apparatus for suspending coiled tubing and equipment in a well including a tubing head having a vertical flow passage therethrough. A hanger assembly is carried in an inverted frusto-conical recess of the flow passage. The hanger assembly includes segmented slip and seal members moveable between outwardly expanded passive positions in which the slip and seal members do not interfere with full bore flow passage and inwardly contracted active positions in which gripping surfaces carried on slip members engage the coiled tubing to support the weight thereof, the weight of the tubing being transferred from the slip members to the sealing members. Slip activators carried by the tubing head are manipulatable externally of the tubing head to move the slip members from passive positions to active positions. Methods of utilizing the apparatus to install coiled tubing and equipment in a well are disclosed.

18 Claims, 3 Drawing Sheets

APPARATUS AND METHOD FOR INSTALLING COILED TUBING IN A WELL

CROSS REFERENCE TO RELATED APPLICATION

The present application is a continuation-in-part of U.S. patent application Ser. No. 08/308,407 filed Sep. 18, 1994.

BACKGROUND OF THE INVENTION

1. Field of the Invention

The present invention pertains to methods and apparatus for installing and suspending tubing in an oil and/or gas well. More specifically, the present invention pertains to methods and apparatus for installing and suspending coiled tubing and associated apparatus in an oil and/or gas well.

2. Description of the Prior Art

In the drilling and completion of an oil and/or gas well, a hole is drilled through the earth to a subterranean formation which comprises a reservoir for oil and/or gas. Typically, the drilled hole is lined with a string of pipe, sometimes referred to as a "casing string", and one or more smaller diameter strings of pipe are lowered therein and supported at the surface of the well by a wellhead. The smaller diameter pipe, sometimes referred to as "tubing", is the pipe through which the oil and/or gas typically rises to the surface of the well, by natural pressures or by pumping, for production. The tubing string may also be used to run safety valves, packers, plugs and other apparatus into the well.

Typically, such tubing is manufactured in rigid joints of 40 to 80 foot sections. The joints must be transported to the well, stored on a pipe rack and vertically positioned in a derrick or the like before installation in the well. Then they are threadedly connected, joint by joint, as the string is lowered into the well. If it becomes necessary to reposition or remove the tubing, it must be disconnected, joint by joint, and removed from the well. Obviously, these procedures are labor and time intensive, resulting in relatively expensive operations.

In recent years, coiled tubing has been developed and used in the oil field as an alternative to conventional jointed tubing. Coiled tubing offers many advantages over conventional jointed tubing, including time and labor savings, pumping flexibility, elimination of leakage and leak testings, reduced formation damage, safety, etc. The coiled tubing may range in sizes from ¾" OD up to 3 ½" OD. The operational concept of a coiled tubing system involves running a continuous string of small diameter tubing into a well to perform specific well servicing operations without disturbing existing completion tubulars and equipment. When servicing is complete, the small diameter tubing and servicing equipment may be retrieved from the well and the coiled tubing spooled onto a large reel for transport to and from work locations.

Although coiled tubing has been in use since the early 1960's, it's use in production applications has only begun to gain widespread acceptance in the last few years. Producers have for several years successfully used concentric coiled tubing inside larger conventional tubing to enable the wells to continuously unload liquids. For example, coiled tubing has been used to jet sludge from wells as deep as 20,000 feet prior to hanging the string off and then unloading water through the "siphon" tubing to increase gas production. In the past few years, coiled tubing has begun to gain acceptance as a primary production string. Coiled tubing can be run in underbalanced well conditions to minimize formation damage from completion of workover operations. Installation and removal are generally faster than with jointed pipe. Joint connections are reduced or eliminated, minimizing potential for leaks and the need for testing connections. Cost is competitive with jointed pipe in most sizes. Coiled tubing is compatible with most artificial lift methods.

The typical procedure for hanging coiled tubing from the surface as a production or an injection string may include the following steps:

1. Rigging up a coiled tubing unit and killing the well if necessary.

2. Installing a coiled tubing head. This may already be in place or may be in addition to existing wellhead equipment. Many times the tubing head will be installed on the lower master valve.

3. Nippling up or installing blowout preventers (BOP's) on the tubing head. This usually also includes, above the blowout preventers, an access window assembly.

4. Running coiled tubing with a shear out or pump out bottom plug on the lower end to prevent possible well flow back through the coiled tubing. The BOP's may be used for annular well control.

5. When the end of the coiled tubing reaches the desired depth, the lower set of BOP's are closed and the tubing is checked for leaks.

6. The distance from the bottom flange of the access window assembly to tubing head lock screws is measured to insure that the annular hanger assembly sets completely in its hanger profile.

7. A wrap around style annular hanger assembly (with slips and seals) is placed around the coiled tubing and slowly lowered to the top of the lower set of blowout preventer rams.

8. The upper blowout preventers are closed and the lower blowout preventers are opened, allowing pressure to equalize across the spool.

9. The hanger assembly is lowered to the depth of a hanger bowl and the weight of the tubing is landed on the hanger. Lock down screws are engaged and the hanger's seals are pressure tested.

10. The coiled tubing is rough cut through the window of the access window assembly and the blowout preventers and access window assembly are removed.

11. A final or smooth cut is made on the coiled tubing and it is beveled to fit an adapter and to avoid damaging adapter seals. The remaining wellhead equipment is then installed and flow lines connected.

12. The coiled tubing is pressured up to shear out the bottom plug.

13. The well is placed in service.

In the typical coiled tubing installation of the prior art just described, it is, as indicated, necessary to provide an access window assembly above the blowout preventers to provide access to the coiled tubing and the annular space surrounding the coiled tubing in the tubing head. It is necessary to open the access window assembly for placement of the hanger assembly around the coiled tubing so that it may be lowered into the tubing head. Even though pressure control may be maintained by blowout preventers, this potentially opens the annular space surrounding the coiled tubing to pressure in the well. As is well known in the industry, an oil and/or gas well that is not under total pressure control can result in dangerous situations. The fact that the hanger assembly must be lowered around the coiled tubing from a point near the bottom of the access window assembly to the seating area in the tubing head, without being seen, also provides a potential for improper seating of the hanger seal and actuation of it's slips. Wrap-around slip and sealing assemblies of such hangers are inherently more likely to create sealing or slip engagement problems.

Even though coiled tubing installations, particularly production applications thereof, have become widely accepted in the last few years, apparatus and methods for completing and producing wells with coiled tubing continue to be developed. For example, the method and apparatus of copending application Ser. No. 08/308,407 provides substantial improvements for installing coiled tubing in an oil and/or gas well, particularly for production of hydrocarbon fluids therefrom. It provides a tubing head and hanger which, unlike the prior art, is designed so that the tubing unit stripper or blowout preventers do not have to be disconnected to hang the coiled tubing string in the well. Furthermore, all components of the hanger apparatus are internal, eliminating the need to install access window assemblies to set the tubing in the hanger and thus eliminating the pressure control problems associated with such.

The hanger apparatus of Ser. No. 08/308,407 includes a tubing head, having a vertical flow passage therethrough, for surmounting on the wellhead of the well. An annular sealing assembly is carried in a counterbored portion of the flow passage and a slip assembly is carried in a second counterbored portion above the first mentioned counterbored portion. The sealing and slip assemblies make up the hanger assembly. Also carried by the tubing head are slip activation devices which engage the slip assembly within the second counterbored portion of the flow passage and which are manipulatable externally of the tubing head to move the slip assembly from passive positions to active positions.

In the method of installing coiled tubing with the apparatus of Ser. No. 08/308,407, the coiled tubing hanger apparatus, which includes the tubing head, annular seal assembly and slip assembly are all installed on the wellhead, completely assembled, prior to lowering the coiled tubing into the well. A blowout preventer stack and the coiled tubing injector apparatus are installed thereabove. The coiled tubing is run through the blowout preventer stack and the coiled tubing head until the string of coiled tubing reaches its desired depth in the well. This is done while the slip assembly is in an expanded passive position. After the coiled tubing has reached the proper depth, the slip assembly is activated externally of the tubing head, the slips thereof moving to a contracted active position grippingly engaging a portion of the coiled tubing which it surrounds. Then the coiled tubing is slightly lowered to allow the weight of the tubing string to be totally supported by the slip assembly, the weight of the coiled tubing also expanding the sealing assembly to seal around the coiled tubing. After the coiled tubing is so hung and sealed, it is cut off at a point above the hanger apparatus, the injection apparatus and the blowout preventer stack are removed and remaining wellhead equipment installed.

Thus, the apparatus and method of Ser. No. 08/308,407 allows the use of coiled tubing for production applications without having to disconnect the tubing injector apparatus or blowout preventers and without having to use an access window assembly. There is complete pressure control of the well at all times. The internal slip and seal assemblies are contained within the coiled tubing head but are activated externally thereof. Furthermore, the slip assembly may be moved or retracted to an inactive or passive position to allow the coiled tubing to be repositioned, lower or higher in the well, without pulling the tubing.

While the apparatus of Ser. No. 08/308,407 is a substantial improvement over the prior art, particularly in production applications, the related sealing and slip assemblies may not provide enough clearance to allow lowering of packers, safety valves or other tools through the tubing head. There are many situations in which it would be desirable to use such equipment while providing the other advantages of coiled tubing.

SUMMARY OF THE PRESENT INVENTION

The present invention provides methods and apparatus for installing coiled tubing and related equipment in an oil and/or gas well. The apparatus of the present invention includes a tubing head and hanger which, like that of Ser. No. 08/308,407 but unlike the prior art, is designed so that the tubing unit stripper or blowout preventers do not have to be disconnected to hang the coiled tubing string in the well. All components of the hanger apparatus are internal, eliminating the need to install access window assemblies to set the tubing in the hanger and thus eliminating the pressure control problems associated with such.

The hanger apparatus of the present invention includes a tubing head, having a vertical flow passage therethrough, for surmounting on the wellhead of the well. The flow passage includes at least one cylindrical bore and a coaxially aligned inverted frusto-conical recess providing an upwardly and outwardly flaring or tapered slip seating surface. A hanger assembly is carried in the frusto-conical recess and includes a plurality of segmented slip and seal members moveable between upwardly and outwardly expanded passive positions within the recess and downwardly and inwardly contracted active positions in which the slip and seal members are engageable with coiled tubing disposed in the flow passage to sealingly support the coiled tubing with the tubing head. In the outwardly, expanded passive positions, the slip and seal members lie totally outside of the diameter of the cylindrical bore of the flow passage, providing full bore access for passage of the coiled tubing and related apparatus through the tubing head.

Also carried by the tubing head are slip activation devices which engage the hanger assembly within the recessed portion of the flow passage and which are manipulatable externally of the tubing head to move the slip and seal members of the hanger assembly from passive positions to active positions. In a preferred embodiment of the invention, the slip activation devices are a plurality of screws which may be rotated externally of the tubing head but which extend through threaded holes for engagement with the hanger assembly for movement thereof.

In the method of installing coiled tubing with the apparatus of the present invention, the coiled tubing hanger apparatus, which includes the tubing head and the hanger assembly are all installed on the wellhead, completely assembled, prior to lowering the coiled tubing into the well. A blowout preventer stack and the coiled tubing injector apparatus are installed thereabove. The coiled tubing, and any other equipment attached thereto, is run through the blowout preventer stack and the coiled tubing head until the string of coiled tubing reaches its desired depth in the well. This is done while the hanger assembly is in its expanded passive position with all components thereof completely without the diameter of the cylindrical bore of the tubing head. After the coiled tubing has reached the proper depth, the hanger assembly is activated externally of the tubing head, the slip and seal members thereof moving to contracted active positions grippingly engaging a portion of the coiled tubing which they surround. Then the coiled tubing is slightly lowered to allow the weight of the tubing string to be totally supported by the hanger assembly, the weight of the coiled tubing also expanding the seal members of the hanger assembly to seal around the coiled tubing. After the coiled tubing is so hung and sealed, it is cut off at a point above the hanger apparatus. The injection apparatus and the blowout preventer stack are removed and remaining wellhead equipment installed.

Thus, the apparatus and method of the present invention allows the use of coiled tubing for service and production applications without having to disconnect the tubing injector apparatus or blowout preventers and without having to use an access window assembly. There is complete pressure control of the well at all times. The internal slip and seal members of the hanger assembly are contained within the coiled tubing head but are activated externally thereof. Furthermore, the hanger assembly may be moved or retracted from an active position to a passive position to allow the coiled tubing and equipment attached thereto to be repositioned, lower or higher in the well, without pulling the tubing. One particular object of the invention is to provide full bore access through the tubing head when the hanger assembly is in its passive position. Many other objects and advantages of the apparatus and method of the present invention will be apparent from reading the description which follows in conjunction with the accompanying drawings.

DESCRIPTION OF PREFERRED EMBODIMENT OF THE INVENTION

Figure 1:
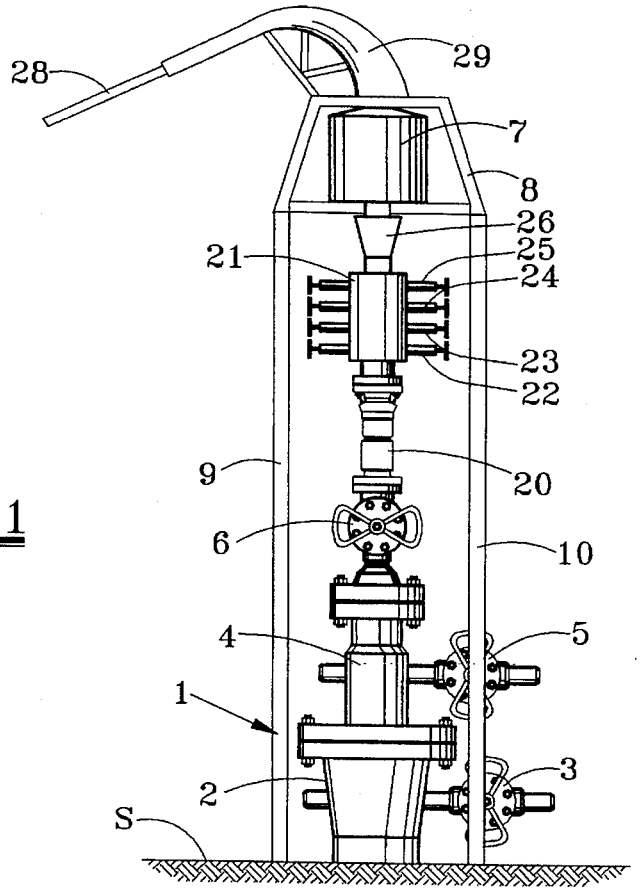
FIG. 1 is a vertical elevation view of the wellhead of an oil and/or gas well and hanger apparatus for running and hanging a string of coiled tubing therein according to a preferred embodiment of the invention.
Figure 5:
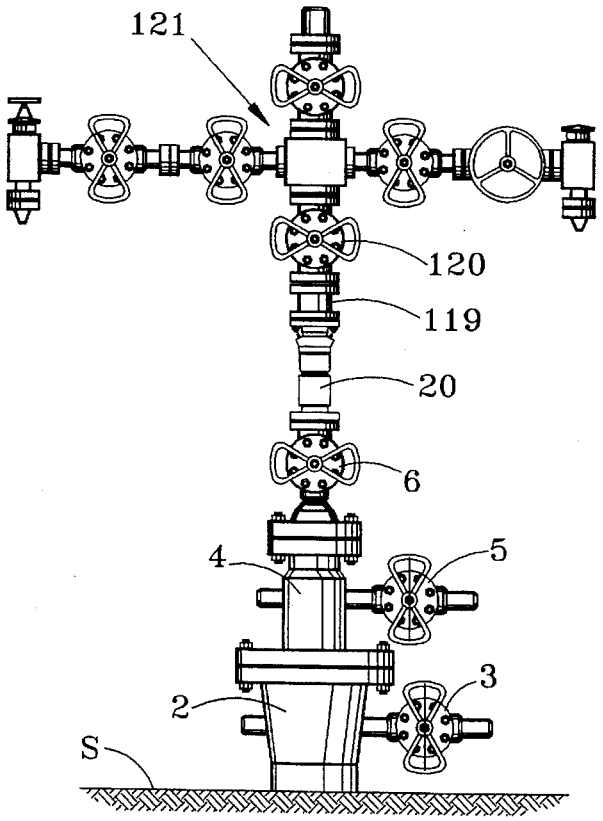
FIG. 5 is a vertical elevation view of a completed wellhead utilizing the coiled tubing hanging apparatus of the present invention, according to a preferred embodiment thereof.

Referring first to FIG. 1, there is shown the wellhead 1 of an oil and/or gas well which is to produce from a subterranean formation many feet below the surface S. The wellhead 1 is made up of a number of components. For example, a casing head 2 may be attached to the upper end of an outer casing and equipped with one or more valves 3. Another casing or tubing head 4 equipped with one or more valves 5 may be surmounted on the casing head 2 and may be attached to the upper end of a smaller production casing or tubing string. One or more tubing strings may be supported in the tubing head 4 from a tubing hanger (not shown) at the upper end thereof. In fact, such a tubing string may actually be the original production tubing through which the well produces. A master control valve 6 may be attached to the upper end of the tubing head 4. The casing and tubing strings (not shown) supported from the casing head 2 and tubing head 4 and/or the tubing strings supported therein might be strings previously placed in the well at some prior time. In any event, for purposes of illustrating the present invention, it is to be assumed that a string of coiled tubing is to be run into the well, the coiled tubing being concentrically disposed within the innermost string of jointed pipe, either a casing string or a tubing string.

To begin running coiled tubing, a coiled tubing unit which includes a tubing injector 7 would need to be brought in place. The injector 7 is typically provided with a protective frame 8 and mounted on adjustable support legs 9 and 10. Prior to connection of the injector 7 for running of the coiled tubing, it may be necessary to kill the well. A coiled tubing head 20 is installed. The coiled tubing head 20 illustrated in FIG. 1 is a specially designed coiled tubing head which includes hanger apparatus, including internal slip and sealing apparatus for supporting and sealing around coiled tubing in the well. This coiled tubing head 20 will be described in greater detail hereafter. For present purposes, it should be mentioned that the coiled tubing head 20 could already be in place or may be an addition to existing wellhead equipment. Most times, the coiled tubing head 20 would be installed directly above the lower master valve 6. If other wellhead equipment previously existed above the lower master valve 6, it might have to be removed.

Mounted directly above the coiled tubing head 20 is a blowout preventer stack 21 which would typically include four ram type blowout preventers, tubing rams 22, slip rams 23, cutter rams 24 and blind rams 25. The blowout preventers 21 are used, of course, as a primary means of well control during the running of coiled tubing.

Mounted between the blowout preventer stack 21 and the injector 7 is a stuffing box or "stripper rubber" 26 which normally contains a split elastomeric element which is compressed against the coiled tubing as it is injected into the well by the injector 7. The stripper 26 isolates the annulus wellbore pressure from the atmosphere.

Tubing to be injected into the well is normally stored on a coiled tubing reel (not shown) which may store 20,000 feet or more of tubing depending upon its diameter. The tubing 28 would be dispensed from the reel through a tubing guide 29 into the injector 7. The injector 7 does not form a part of the present invention. There are several types of injectors which could be used. In one design used in the industry today, the continuous coiled tubing string is manipulated by utilizing two opposed sprocket-driven traction chains which are powered by contra-rotating hydraulic motors. The chains are fabricated with interlocking saddle blocks mounted between chain links and machined to fit the particular coiled tubing diameter with which they are to be used. Hydraulically actuated compression rollers force the saddle blocks onto the coiled tubing with enough force to establish frictional drive. The tubing guide 29 essentially straightens the coiled tubing as it is fed into the injector 7.

Figure 2:
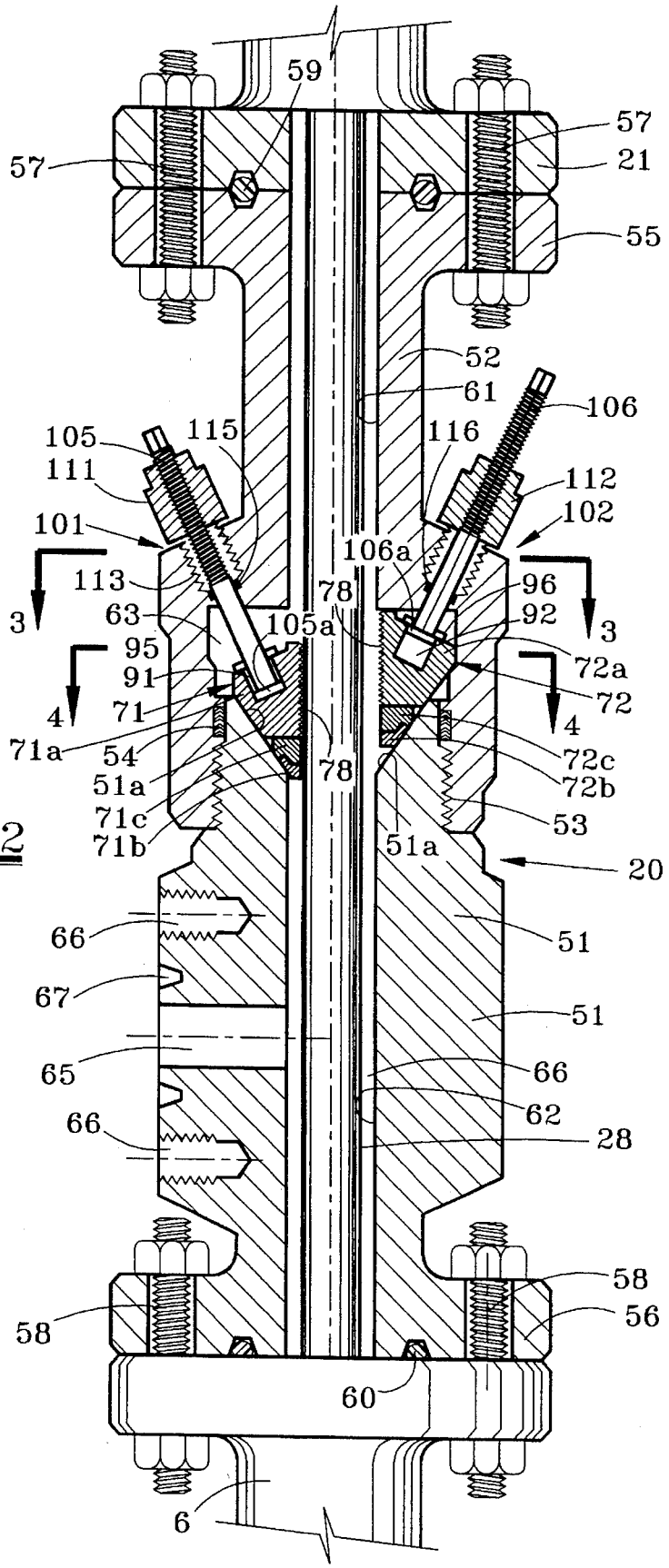
FIG. 2 is a vertical elevation view, in section, of a tubing hanger head, with combination slip and sealing hanger assembly, for lowering coiled tubing therein with apparatus such as shown in FIG. 1, the right-hand part of the drawing illustrating the hanger assembly in its non-engaging or passive position and the left-hand part of the drawing illustrating the hanger assembly in its engaging or active position.
Figure 3:
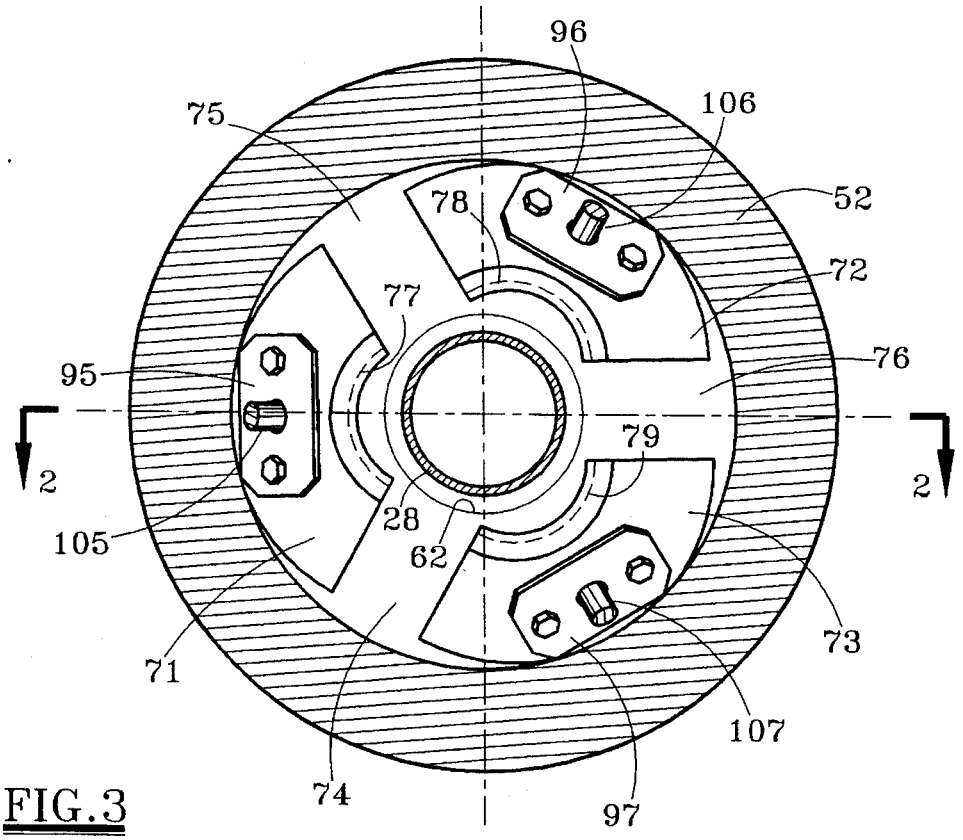
FIG. 3 is a cross-section view of the coiled tubing hanger head of FIG. 2, taken along lines 3—3 thereof, showing the hanger assembly in its non-engaging or passive position.
Figure 4:
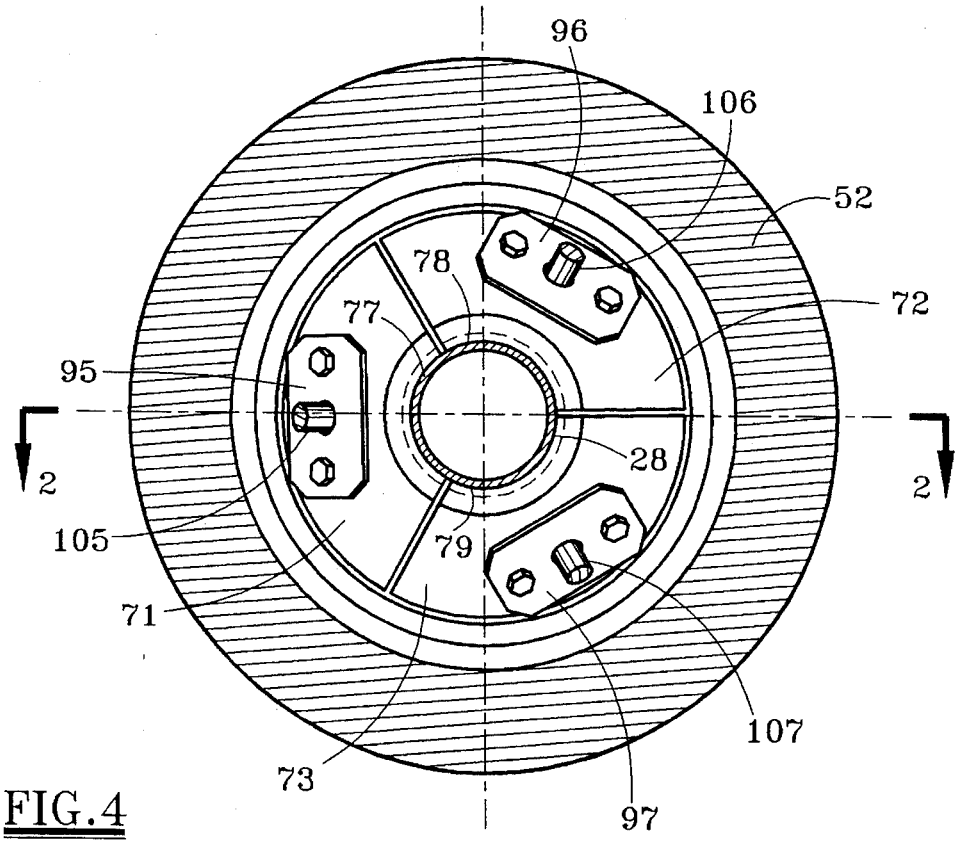
FIG. 4 is a cross-sectional view of the coiled tubing hanger head of FIG. 2, taken along lines 4—4 thereof, showing the hanger assembly in its engaging or active position.

Referring now to FIGS. 2, 3 and 4, the specially designed tubing hanger apparatus of the present invention will be described in detail. The coiled tubing head 20 comprises a lower body 51 and an upper body 52 connected by a threaded pin and box connection 53 which is sealed by an annular seal 54. The upper and lower ends of the tubing head 20 may be provided with pin and box type connections or with flanges 55 and 56, as shown in FIG. 2. Radially disposed holes are provided in the flanges 55 and 56 for receiving bolts 57, 58 for connection to wellhead components such as the blowout preventers 21 and the master control valve 6 of FIG. 1. The flanges 55, 56 are provided with annular grooves for receiving seal rings 59, 60.

The body 51, 52 of the tubing hanger head 20 has a vertical flow passage therethrough. The flow passage, in the exemplary embodiment of FIG. 2, comprises upper and lower cylindrical bore sections 61, 62 joined by an intermediate section 63 formed by an inverted generally frusto-conical recess. An outlet flow passage 65 may be provided for communication with the annulus 66 of the lower bore 62 when a coiled tubing 28 is concentrically positioned therein. Drilled and tapped holes 66 may be provided on the lower body 51 around the outlet 65 to receive the base of a valve or other component (not shown). An annular recess 67 may be provided for an annular seal ring (not shown).

The flow passage recess 63 formed in lower and upper bodies 51, 52 receives a hanger assembly which comprises a plurality, three in the exemplary embodiment, of composite slip and seal segments 71, 72, 73. These composite slip and seal members 71, 72, 73 are moveable between upwardly and outwardly expanded passive positions, as illustrated by slip and seal members 72 in FIG. 2, and downwardly and inwardly radially contracted active positions, as illustrated by slip and seal members 71 in FIG. 2.

Each of the segmented slip and seal members 71, 72, 73 is a composite of an upper slip 71*a*, 72*a*, 73*a*, a lower slip 71*b*, 72*b*, 73*b* and an intermediate seal 71*c*, 72*c*, 73*c*. The upper and lower slips would be of rigid materials such as steel. The intermediate seal would be of an elastomeric material bonded or otherwise sandwiched to and between the upper and lower slips. The outer surfaces of at least the upper and lower slips 71*a–c* and 73*a–c* substantially define, when in the contracted active positions of FIG. 4, an inverted frustrum of a cone. This inverted frustrum of a cone corresponds with and engages the upwardly and outwardly tapered or flared frusto-conical slip seating surfaces 51 provided on the lower tubing head body 51 and defining the lower limits of recess 63.

As earlier stated, the slip and seal segments 71, 72, 73 are moveable between upwardly and radially outwardly expanded passive positions within recess 63, as illustrated in FIG. 3 and in the right hand half of FIG. 2 and downwardly and radially inwardly contracted active positions, as illustrated in FIG. 4 and in the left hand half of FIG. 2. In the radially expanded passive positions, the slip and seal members 71, 72 and 73 are separated by spaces 74, 75 and 76 (See FIG. 3) and lie totally without the diameter of cylindrical bores 61, 62. Thus, with the slip and seal member 71, 73 and 73 in the passive position, the coiled tubing 28 and/or any other piece of equipment which can pass through the full bores 61, 62 can be raised or lowered through the tubing hanger head 20.

It will be noted that the inner cylindrical surfaces of at least the upper slips 71*a*, 72*a* and 73*a* are provided with upwardly directed frictional engaging surfaces, such as teeth 77, 78, 79. When the slip and seal members 71, 72 and 73 are in the radially contracted active positions they essentially encircle the coiled tubing 28, as best illustrated in FIG. 4. In this position, teeth 77, 78 and 79 engage the coiled tubing 28. If the weight of the tubing 28 is then supported by slip and seal members 71, 72, 73, the wedging action between the slip and seal members 71, 72, 73 and the frusto-conical surface 51*a* will cause the seal members 71*c*, 72*c*, 73*c* to be squeezed and axially contracted between upper and lower slips 71*a*, 72*a*, 73*a* and 71*b*, 72*b* and 73*b*, respectively. As this occurs the seal members 71*c*, 72*c* and 73*c* also expand outwardly against surface 51*a* and inwardly against coiled tubing 28 creating a fluid tight annular seal between the coiled tubing 28 and the hanger head body 51.

To provide for moving the slip and seal members 71, 72, 73 between the passive positions of FIG. 3 and the right hand half of FIG. 2 and the active positions of FIG. 4 and the left hand half of FIG. 2, slip activation assemblies, one for each, are provided. Although there are three in the exemplary embodiment, only two slip activation assemblies 101, 102 are visible in FIG. 2. The upper slips 71*a*, 72*a*, 73*a* of the slip and seal members 71, 72, 73 are provided with inclined cylindrical recesses 91, 92, 93 which are engageable by the inner ends of slip activation assemblies 101, 102, 103, one for each slip member 71*a*, 72*a*, 73*a*, which are manipulatable externally of the tubing head 20 to move the slip and seal members 71, 72, 73 from the passive or inactive position of FIG. 3 to an active position (see FIG. 4) in which the gripping means 77, 78, 79 on the upper slips 71*a*, 72*a*, 73*a* engage the coiled tubing 28.

In the preferred embodiment, the slip activation assemblies 101, 102, 103 include slip activation screws 105, 106, 107, the upper ends of which are threaded to engage corresponding threads of gland nuts 111, 112 in a threaded connection. The gland nuts 111, 112 have reduced diameter threaded portions 113, 114 which engage corresponding threaded holes in the upper body 52 abutting annular packing 115, 116 which seals the interior of the tubing head 20 from the exterior thereof. The lower ends of the slip activation screws 105, 106, 107 are provided with enlarged heads 105*a*, 106*a*, 107*a* which engage the corresponding cylindrical recesses 91, 92, 93 of slips 71*a*, 72*a*, 73*a* and are maintained therein by retainer plates 95, 96, 97 attached to the top of each upper slip 71*a*, 72*a*, 73*a*. These retainer plates 95, 96, 97 are provided with holes which allow reciprocation of the lower ends 105, 106,107 of the slip activation screws but do not allow escape of the enlarged heads 105*a*, 106*a*, 107*a* thereof. Rotation and extension of the activation screws 105, 106, 107 toward the flow passage 61, 62, 63 will force the slip and seal members 71, 72, 73 to move downwardly and inwardly toward the contracted active position of FIG. 4. Rotation of the activation screws 105, 106, 107 in the opposite direction results in retraction of the activation screws, effecting upward and outward movement of the slip and seal members 71, 72, 73 to the expanded, passive or inactive positions of FIG. 4.

Referring now to FIGS. 1–5, operation of the apparatus of the present invention and the method of installing coiled tubing in a well therewith will be described. As previously mentioned with reference to FIG. 1, the coiled tubing head 20, with the slip and seal assemblies 71, 72, 73 previously installed as in FIG. 2, is mounted on one of the components of the wellhead 1 such as the master valve 6. The blowout preventer stack 21 is mounted on the coiled tubing head 20 and the coiled tubing injector apparatus, i.e. stripper 26, injector head 7, etc. are attached to the blowout preventers 21. Then the coiled tubing 28 and any other attached equipment which can pass through bores 61 and 62 could be run through the blowout preventer stack 21, the coiled tubing head 20 and the casing head 2 until the string of coiled tubing 28 and/or other equipment reaches the desired depth in the well.

As indicated, the seal members 71*c*, 72*c*, 73*c* of the slip and seal members 71, 72, 73 are in the inactive or passive positions of FIG. 3 and the right hand half of FIG. 2 as the coiled tubing is being run into the well. Once the coiled tubing 28 reaches the desired depth, the slip and seal members 71, 72, 73 are activated externally of the coiled tubing head 20 by rotating the slip activation screws 105, 106, 107 until the slip and seal members 71, 72, 73 move downwardly and inwardly to the contracted active positions, grippingly engaging a portion of the coiled tubing 28 surrounded thereby. When this occurs, the coiled tubing 28 is slightly lowered to allow the weight thereof to be totally supported by the slip and seal members 71, 72, 73. The upper slips 71*a*, 72*a*, 73*a* transfer the weight of the coiled tubing 28 to the seal members 71*c*, 72*c*, 73*c*. As this occurs, the seal members 71*c*, 72*c*, 73*c* are axially compressed and expand inwardly and outwardly to sealingly engage the coiled tubing 28 and the surrounding surface 51*a* of the frusto-conical recess 63 in which the slip and seal assemblies 71, 72, 73 are disposed. See FIG. 4 and the left hand half of FIG. 2.

If for any reason, it is determined that the coiled tubing 28 needs to be repositioned, lower or higher, or removed, the weight of the coiled tubing 28 is first released from the slip and seal members 71, 72, 73 by picking it up with the injector apparatus 7. Then the slip and seal members 71, 72, 73 are deactivated externally of the tubing head 20 by rotating the activation screws 105, 106, 107 in the opposite direction, retracting the activation screws 105, 106, 107 and moving the slip and seal members 71, 72, 73 from their active contracted positions back to the expanded passive positions. Since the weight of the coiled tubing 28 is then removed, the seal members 71*c*, 72*c*, 73*c* will assume the relaxed or nonset position. The coiled tubing may be repositioned, higher or lower in the well, and the slip and seal members 71, 72, 73 reactivated externally of the tubing head 20 so that they return to the contracted active positions grippingly engaging a portion of the coiled tubing 28 surrounded thereby. The coiled tubing 28 may then again be slightly lowered to allow the weight thereof to again be supported by the upper and lower slips 71*a*, 72*a*, 73*a* and 71*b*, 72*b*, 73*b* and the seal members 71*c*, 72*c*, 73*c*, the weight thereof causing the seals 71*c*, 72*c*, 73*c* to again seal around the coiled tubing 28.

Once the coiled tubing is properly positioned in depth, the slip and seal members 71, 72, 73 properly set and sealed, the blowout preventer stack 21 and the injection apparatus 7 may be removed. At some point in this process, the coiled tubing 28 is cut at a point above the tubing head 20. Then additional wellhead equipment such as an adapter 119, an upper master valve 120, and other flow connections of a well manifold or Christmas tree 121 may be installed. See FIG. 5.

Thus, the apparatus and method of the present invention allows the running of coiled tubing into a well for production of fluids from the well or the running of other equipment therein with complete pressure control of the well at all times. The unique coiled tubing head and hanger apparatus contained therein eliminates the need for an access window assembly and the potential pressure control problems associated therewith. The hanger slip and seal members of the present invention are initially positioned, prior to the running of the coiled tubing, so that there is no possibility of them being improperly disposed as in the case of prior art apparatus in which the hanger components must be wrapped around the coiled tubing through access windows and dropped down into a tubing head, sight unseen, with potential setting problems. The apparatus and method of utilizing the apparatus of the present invention in running of coiled tubing and associated apparatus is unique and is a substantial improvement over the prior art.

A single embodiment of the apparatus of the present invention and method of use thereof have been described herein. However, many variations in the apparatus and methods of its use can be made without departing from the spirit of the invention. Accordingly, it is intended that the scope of the invention be limited only by the claims which follow.

I claim:

1. Hanger means for suspending coiled tubing in a well on the wellhead of which said hanger means is to be mounted, said hanger means comprising:

a tubing head having a vertical flow passage therein through which said coiled tubing may be raised and lowered, said flow passage including at least one cylindrical bore and a coaxially aligned inverted frusto-conical recess providing an upwardly and outwardly tapered frusto-conical slip seating surface, the minor diameter of said frusto-conical recess being at least as great as the diameter of said cylindrical bore;

a hanger assembly carried in said frusto-conical recess including a plurality of segmented slip and seal members moveable between upwardly and radially outwardly expanded passive positions within said recess, in which all portions of said hanger assembly lie out of the diameter of said cylindrical bore, and downwardly and radially inwardly contracted active positions, in which said slip and seal members are engageable with coiled tubing coaxially disposed in said flow passage to sealingly support said coiled tubing within said tubing head; and slip activation means carried by said tubing head, engaging said slip and seal members and manipulatable externally of said tubing head to move said slip and seal members from said passive positions to said active sealing and supporting positions, said slip activation means also being manipulatable externally of said tubing head to move said slip and seal members from said contracted active positions to said expanded passive positions.

2. Hanger means as set forth in claim 1 in which said tubing head includes sealingly engageable upper and lower body portions which are disengageable to permit removal or replacement of said hanger assembly from or in said frusto-conical recess of said flow passage.

3. Hanger means as set forth in claim 1 in which said segmented slip and seal members include upper and lower slip bodies and an intermediate elastomeric seal therebetween.

4. Hanger means as set forth in claim 3 in which at least a portion of the outer exterior of said upper and lower slips is tapered to provide, when in said active position, downwardly converging frusto-conical surfaces corresponding with the upwardly and outwardly tapered frusto-conical slip seating surface provided by said frusto-conical recess so that at least a portion of the weight of said coiled tubing supported by said hanger assembly is transmitted to said seal member as inwardly directed radial forces for sealing against said coiled tubing.

5. Hanger means as set forth in claim 4 in which at least said upper segmented slips have inner faces on which gripping means are carried and outer faces which together define at least a portion of said downwardly converging frusto-conical surfaces engageable with said corresponding tapered frusto-conical slip seating surface provided by said frusto-conical recess so that upon engagement of said gripping means with said coiled tubing to support the weight of said coiled tubing thereby, said slip members are wedged into tighter gripping engagement with said coiled tubing.

6. Hanger means as set forth in claim 5 in which said inner faces of said upper slips are defined by substantially longitudinal cylindrical sections which when combined and in said active positions, define a cylinder which substantially surrounds a vertical section of said coiled tubing.

7. Hanger means as set forth in claim 6 in which said gripping means comprises a plurality of tooth members which, when said slips are in said active position, radially and circumferentially engage said vertical section of said coiled tubing.

8. Hanger means as set forth in claim 1 in which said slip and seal members comprise a plurality of upper slips having inner faces on which gripping means are carried and outer faces which together define downwardly converging frusto-conical surfaces engageable with corresponding downwardly converging surfaces provided by said frusto-conical recess so that upon engagement of said gripping means with said coiled tubing and the supporting of the weight of said coiled tubing said slip members are wedged into tighter gripping engagement with said coiled tubing.

9. Hanger means as set forth in claim 8 in which said inner faces of said upper slips are defined substantially by longitudinal cylindrical sections which, when combined and in said active positions, form a cylinder which substantially surrounds a vertical section of said coiled tubing.

10. Hanger means as set forth in claim 9 in which said gripping means comprises a plurality of tooth members which, when said hanger assembly is in said active position, radially and circumferentially engage said vertical section of said coiled tubing.

11. Hanger means as set forth in claim 10 in which said slip and seal members also comprise a lower slip and an elastomeric seal ring carried between said upper and lower slips.

12. Hanger means as set forth in claim 1 in which said slip activation means comprises a plurality of activation members radially disposed around said tubing head and the inner ends of which engage said segmented slip and seal members, said activation members being extendable toward and retractable from said flow passage to move said slip and seal members from said passive positions to said active positions and from said active positions to said passive positions, respectively.

13. Hanger means as set forth in claim 12 in which said activation members are downwardly inclined, relative to the axis of said flow passage, so that upon extension of said activation members toward said flow passage said slip and seal members move downwardly and inwardly toward said contracted active positions, retraction of said activation members from said flow passage effecting upward and outward movement of said slip and seal members toward said expanded passive position.

14. Hanger means as set forth in claim 12 in which said plurality of activation members comprise a plurality of screw members threadedly engaging corresponding threaded holes by which rotation of said screw members is translated to axial movement for said extension and retraction thereof.

15. Hanger means as set forth in claim 14 in which said corresponding threaded holes are provided by a plurality of corresponding gland nuts which engage corresponding holes provided in said tubing head, each of said gland nuts being provided with packing means sealing around said screw members to seal the interior of said tubing head from the exterior thereof.

16. A method of installing coiled tubing in a well having at least one string of pipe therein at the upper end of which is attached a wellhead, said method comprising the steps of:

installing a coiled tubing head and hanger assembly on said wellhead, said coiled tubing head having a vertical flow passage therein which includes a cylindrical bore and an enlarged inverted frusto-conical recess, said hanger assembly comprising segmented slip and seal members carried in said recess and being activatable externally of said coiled tubing head for movement between expanded passive positions, in which said hanger assembly does not interfere with passage of full bore sized apparatus, and contracted active positions for engagement with coiled tubing;

installing a blowout preventer stack above said coiled tubing head and hanger assembly;

installing coiled tubing injector apparatus above said blowout preventer;

running coiled tubing and related apparatus through said tubing injector apparatus, said blowout preventer stack, said coiled tubing head and hanger assembly, said wellhead and said string of pipe until the desired depth in said well is reached, said hanger assembly being in said expanded passive position;

activating said hanger assembly externally of said tubing head by rotating activating screws associated therewith, said slip and seal members thereof moving to contracted active positions grippingly and sealingly engaging a portion of said coiled tubing surrounded thereby, said hanger assembly being deactivatable externally of said tubing head by rotating said activating screws in reverse directions to return said slip and seal members to said passive positions;

slightly lowering said coiled tubing to allow the weight thereof to be totally supported by said hanger assembly, the weight of said coiled tubing also expanding said seal members to seal around said coiled tubing, isolating annular spaces below said seal members from annular spaces above said seal members;

removing said injection apparatus and said blowout preventer stack;

cutting said coiled tubing at a point above said hanger assembly; and installing other wellhead equipment above said coiled tubing head.

17. A method of installing coiled tubing as set forth in claim 16 in which said hanger assembly is activated for movement to said contracted active position while the frusto-conical recess in which said hanger assembly is disposed remains isolated from the exterior of said tubing head.

18. A method of installing coiled tubing as set forth in claim 16 in which, prior to said cutting said coiled tubing, the following additional steps are performed:

the weight of said coiled tubing is released from said hanger assembly;

said hanger assembly is deactivated externally of said tubing head to move said hanger assembly to said expanded passive positions;

said coiled tubing is repositioned, higher or lower in said well;

said hanger assembly is reactivated externally of said tubing head, said slip members thereof returning to said contracted active positions grippingly engaging a portion of said coiled tubing surrounded thereby;

slightly lowering said coiled tubing to allow the weight thereof to again be totally supported by said hanger assembly and reexpanding said seal members to seal around said coiled tubing; and continuing with said cutting of said coiled tubing, removing of said injection apparatus and installing of said other wellhead equipment as set forth in claim 16.

* * * * *